United States Patent [19]

Raetzch et al.

[11] 4,088,551

[45] May 9, 1978

[54] ELECTROLYTIC CELL AND METHOD OF ELECTROLYSIS

[75] Inventors: Carl W. Raetzch; Hugh Cunningham; William B. Darlington, all of Corpus Christi, Tex.; Richard J. Blanchfield; Michael A. Wolanyk, both of Chateauguay; Robert Cote, Valleyfield, all of Canada

[73] Assignees: PPG Industries, Inc., Pittsburgh, Pa.; PPG Industries Canada Ltd., Montreal, Canada

[21] Appl. No.: 768,912

[22] Filed: Feb. 15, 1977

[51] Int. Cl.[2] ..... C25B 1/02

[52] U.S. Cl. ..... 204/129; 204/270

[58] Field of Search ..... 204/129, 254–255, 204/256, 268–269, 270, 290 F

[56] References Cited

U.S. PATENT DOCUMENTS

| | | | |
|---|---|---|---|
| 3,759,813 | 9/1973 | Raetzsch et al. | 204/256 |
| 3,849,280 | 11/1974 | Raetzsch et al. | 204/254 X |
| 3,856,651 | 12/1974 | Raetzsch et al. | 204/255 |

*Primary Examiner*—Charles F. LeFevour
*Attorney, Agent, or Firm*—Richard M. Goldman

[57] ABSTRACT

Disclosed is a bipolar electrolyzer having individual bipolar units. Each of the bipolar units has a steel cathodic member and a valve metal anodic member in back-to-back configuration. The bipolar electrolyzer is characterized in that the cathodic member is spaced from the anodic member defining an electrolyte tight compartment therebetween, and that the bipolar unit further has conduit means extending outwardly from between the anodic member and the cathodic member. Also disclosed is a method of electrolysis in a bipolar electrolyzer which method is characterized by collecting hydrogen between the anodic and cathodic members of the bipolar unit and removing the hydrogen so collected through hydrogen removal means.

2 Claims, 9 Drawing Figures

FIG. 1
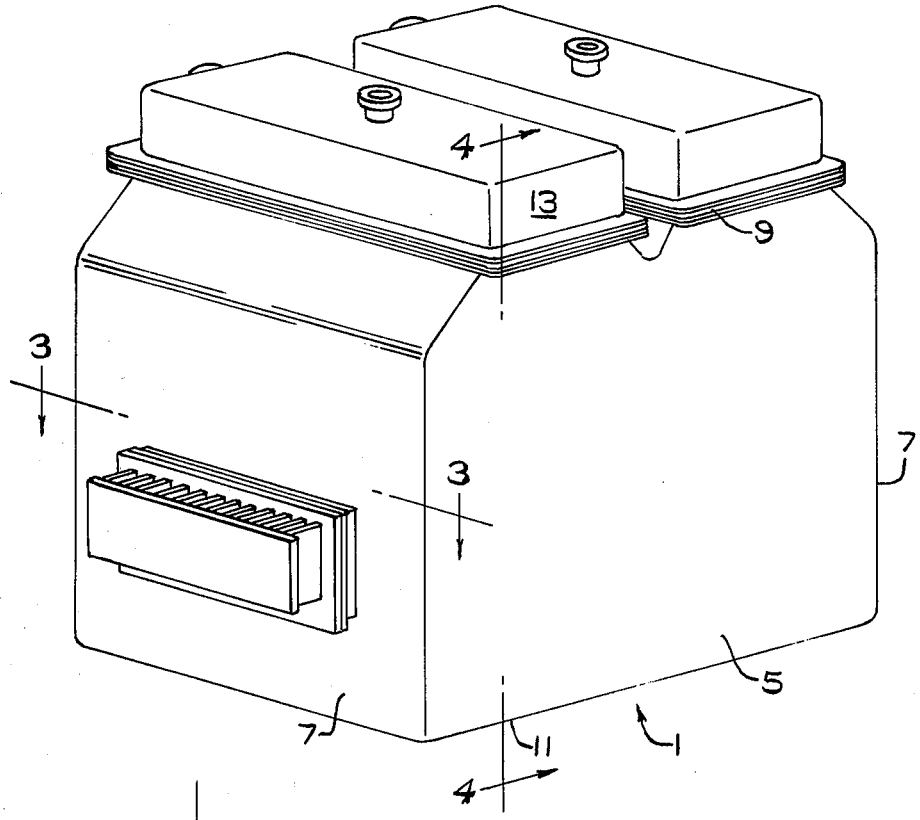
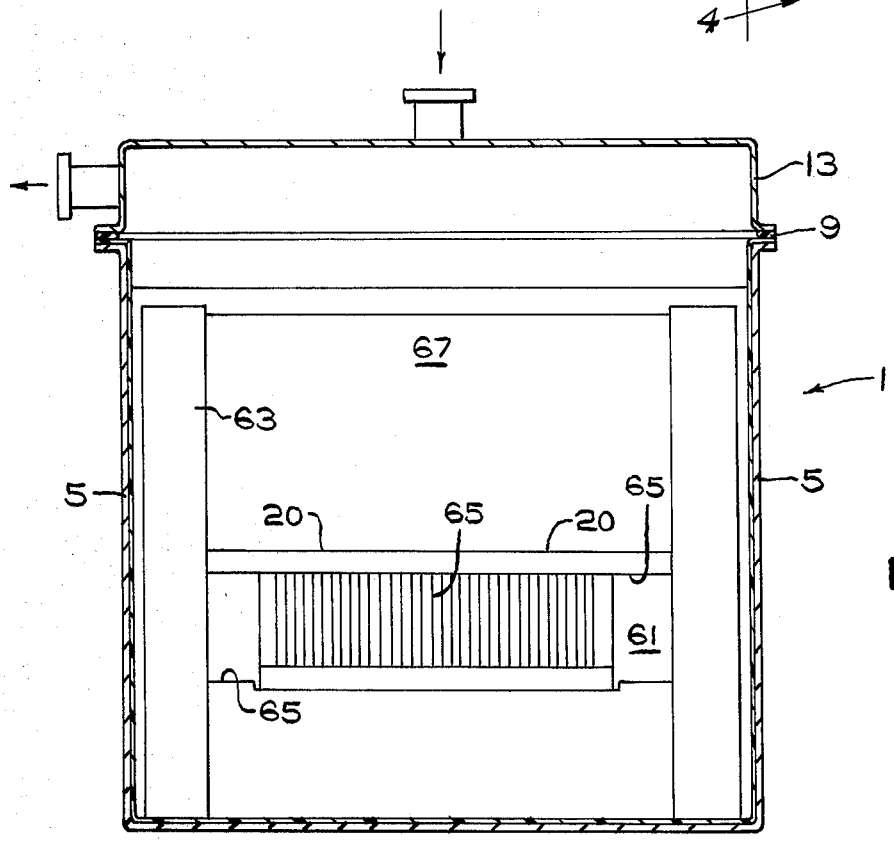
FIG. 4

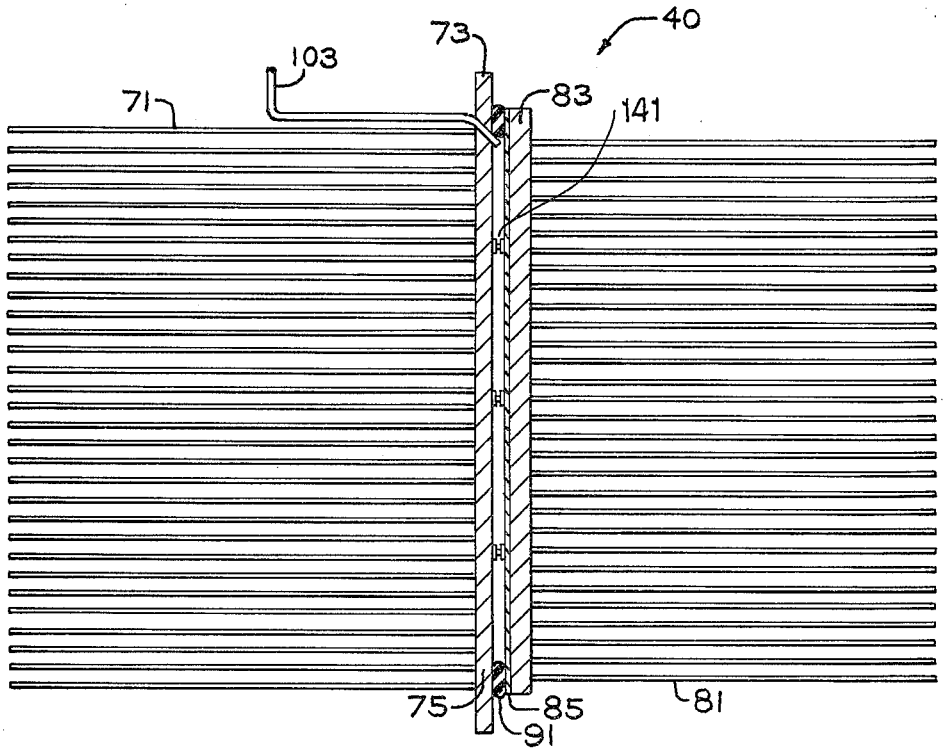
FIG.5
FIG.6
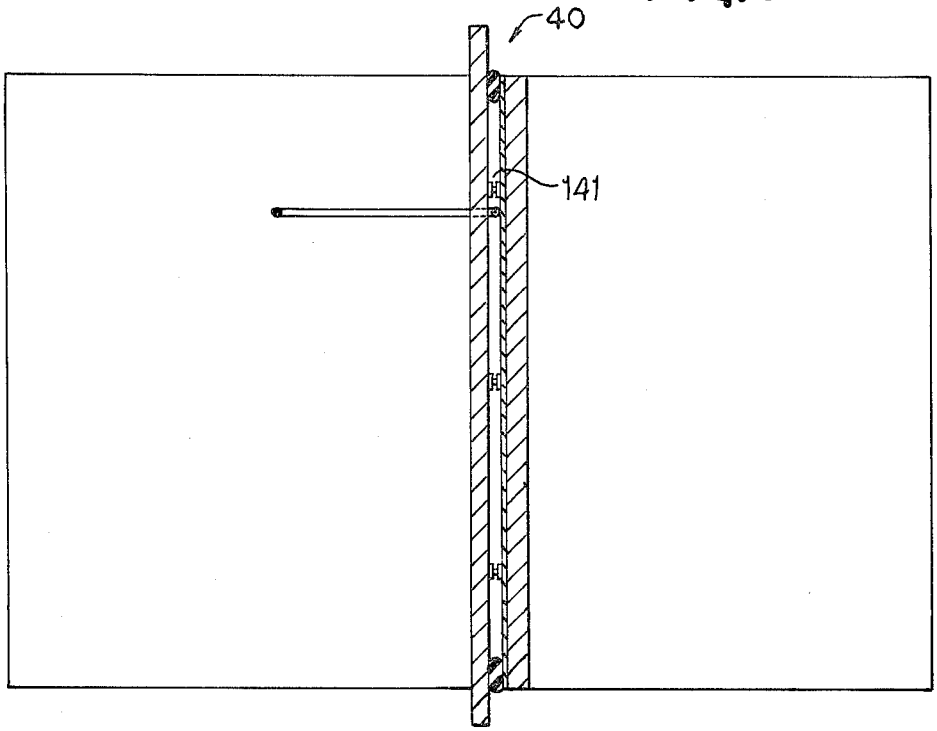

ELECTROLYTIC CELL AND METHOD OF ELECTROLYSIS

DESCRIPTION OF THE INVENTION

Alkali metal halates, such as sodium chlorate, may be prepared electrolytically. For example, in the case of a chlorate cell, alkali metal chloride is fed to an electrolytic cell. Hydrogen is evolved from the cathode and alkali metal hydroxide is produced adjacent to the cathode. Chlorine and hydroxyl ion come into contact within the electrolyte chamber and react according to equations (1A) and (1B):

$$(1A)\ 3Cl_2 + 6OH^- \rightarrow 5Cl^- + ClO_3^- + 3H_2O$$

$$(1B)\ Cl_2 + 2OH^- \rightarrow (Cl^{+1}O)^{-1} + Cl^- + H_2O$$

thereby forming chloride ion, chlorate ion, and hypochlorite ion. The hypochlorite ion, in which the chlorine has a valence of +1, may be self-oxidized to the chlorite ion, in which the chlorine has a valence of +3, and a chloride ion, in which the chlorine has a valence of −1, according to reaction (2):

$$(2)\ (Cl^{+1}O)^{-1} + (Cl^{+1}O)^{-1} \rightarrow (Cl^{+3}O_2)^{-1} + Cl^{-1}$$

The chlorite ion, in turn, is oxidized by hypochlorite ion to chlorate ion in which the chlorine has a valence of +5, as shown in reaction (3):

$$(3)\ (Cl^{+3}O_2)^{-1} + (Cl^{+1}O)^{-1} \rightarrow (Cl^{+5}O_3)^{-1} + Cl^{-1}$$

The starting point of the electrolytic alkali metal chlorate process is the alkali metal chloride, e.g., sodium chloride or potassium chloride, in which the chlorine has a valence of −1. The chlorine in the alkali metal chlorate has a valence of +5. Therefore, the valence change necessary for the production of alkali metal chlorate is from −1 to +5, a total of +6. Six Faradays are required for the production of one equivalent of alkali metal chlorate.

Generally; the major portion of chlorate ion formation is by reaction (1A) rather than by reaction path (1B) through (3).

In the electrolysis of an acidic solution of an alkali metal chloride, a hypochlorite solution is first produced containing little free hypochlorous acid.

Side reactions, e.g., the evolution of oxygen at the anode, and the reaction of nascent hydrogen with oxygen-containing ions, may be reduced by the addition of chromate ion, i.e., sodium chromate, into the electrolyte thereby favoring the evolution of hypochlorite ion and chlorate ion.

The chemical formation of chlorate ion takes place throughout the entire cell, and, in fact, throughout the system wherever hypochlorite ion and hypochlorous acid are present.

Bipolar electrolyzers are frequently used for the electrolytic production of chlorates. In bipolar electrolyzers, the individual electrolytic cells may be electrically connected in series in a common housing with the anodes of one electrolytic cell being in series electrically with the cathodes of the prior cell in the circuit and mounted on the opposite side of the common structural member therewith, and the cathodes being in series with the anodes of the next adjacent cell in the elctrolyzer and mounted on a common structural member therewith. The common structural member is referred to as a backplate. The combination of the anodes of one electrolytic cell and the cathodes of an adjacent electrolytic cell and a backplate is referred to as a bipolar unit or bipolar electrode.

In the operation of sodium chlorate cells in the prior art, the combination of thick consumable electrodes and low current densities, e.g., less than about 100 amperes per square foot, provided a cell operating temperature of from about 40° C. to about 50° C. In such cells, solid sodium chloride had to be substantially continuously added to the electrolyte.

More recently, metal anodes have made chlorate cells capable of operating at closer inter-electrode gaps and higher current densities. As a result, bipolar chlorate cells have been provided having compact electrolysis volumes and large cell bodies, that is, cell bodies characterized by large electrolyte volume. In this way, a small volume is utilized for electrolysis while a large volume is provided within the cell for the chemical formation of chlorate ion.

Because of the increased temperature of the electrolyte due to the higher current densities and closer inter-electrode gaps obtained with metal electrodes, the solubility of alkali metal chlorates in the cell is increased. A large cell volume relative to electrode volume further provides a longer residence time in the cell. The combination of a higher temperature, higher levels of chlorate solubility in the brine, and longer residence times provide higher concentrations of alkali metal chlorate in the cell liquor. The longer residence times allow more of the chlorate to be formed by chemical reaction rather than by electrolysis or to be lost in side reactions, thereby providing a higher current efficiency. The higher temperature allows a brine feed to be utilized rather than a solid salt feed.

The operation of bipolar chlorate cells at high current densities, so as to obtain a high electrolyte temperature, requires that the electrical current flow efficiently through the bipolar unit. However, it has been discovered in the operation of bipolar chlorate cells with backplates having steel and titanium members that atomic hydrogen generated on the steel cathodic surface of the bipolar unit migrates through the steel toward the titanium member of the bipolar unit. This hydrogen is generated by the electrical current that passes from the anode of an individual electrolytic cell through the electrolyte directly towards the steel cathodic surface of the backplate.

In electrolytic cells having bipolar units formed of titanium and steel in mechanical and electrical contact, for example, as in a detonation clad bipolar unit, the passage of hydrogen so generated through the steel member toward the titanium member tends to the formation of titanium hydride which is deleterious to the structural integrity of the backplate. Ultimately, the formation of titanium hydride caused by the migration of hydrogen atoms is apt seriously to weaken the steel-titanium bond, thus weakening the strength of the bipolar unit. Additionally, when the steel cathodic member of the backplate has been fabricated from steel that has been subjected to a considerable amount of cold working, the hydrogen may cause blistering of the steel.

According to the contemplated method of this invention, the formation of hydride is avoided by spacing the cathodic member from the anodic member so as to provide an electrolyte tight compartment therebetween, and providing means, for example, conduit means, extending outwardly from between the anodic member and the cathodic member, to remove the hydrogen that has permeated through the steel cathodic member.

DESCRIPTION OF THE DRAWINGS

FIG. 1 is a perspective view of a bipolar electrolyzer useful in the formation of alkali metal chlorates.

FIG. 4 is a cutaway front elevation view of the bipolar electrolyzer of FIGS. 1, 2, and 3 taken through cutting plane 4—4.

FIG. 5 is a cutaway plane view of an individual bipolar unit of this invention showing the anodic member spaced from the cathodic member and the hydrogen removal means extending into the bipolar unit.

FIG. 6 is a cutaway side elevation of a bipolar unit according to the method of this invention, showing the anodic member spaced from the cathodic member and the hydrogen removal means extending outwardly therefrom.

DETAILED DESCRIPTION

Figure 3:
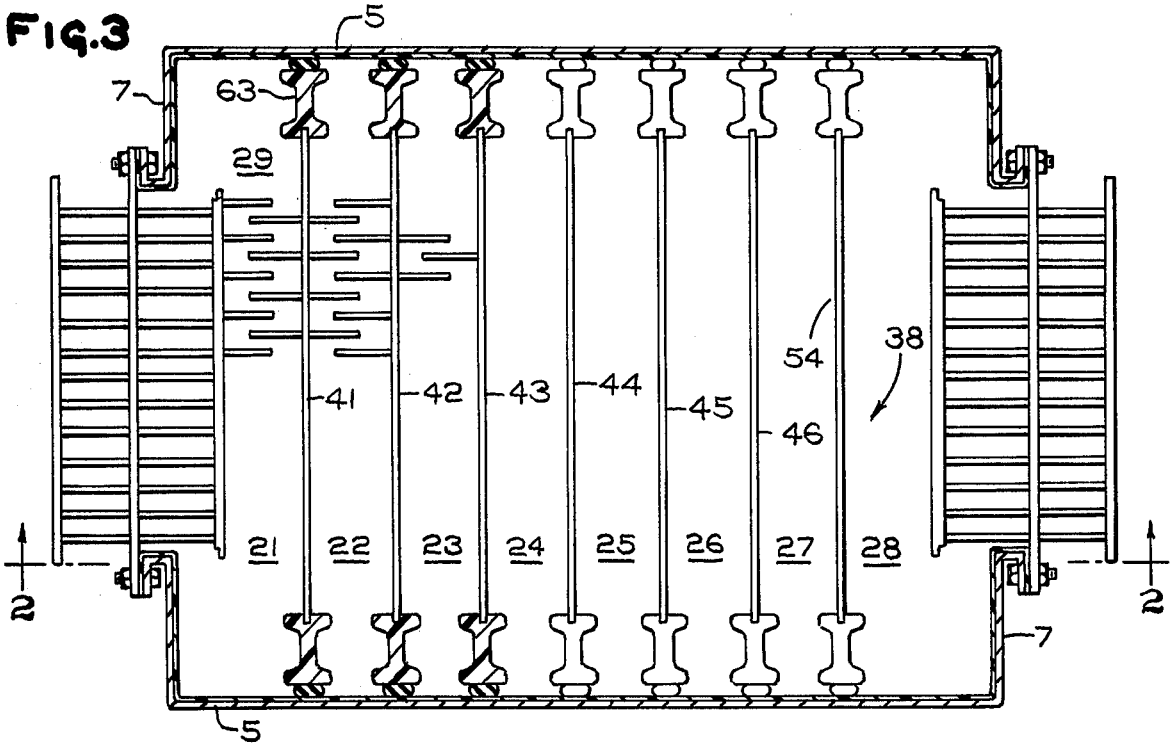
FIG. 3 is a cutaway plane view of a bipolar electrolyzer of FIGS. 1 and 2 taken through cutting plane 3—3.
Figure 2:
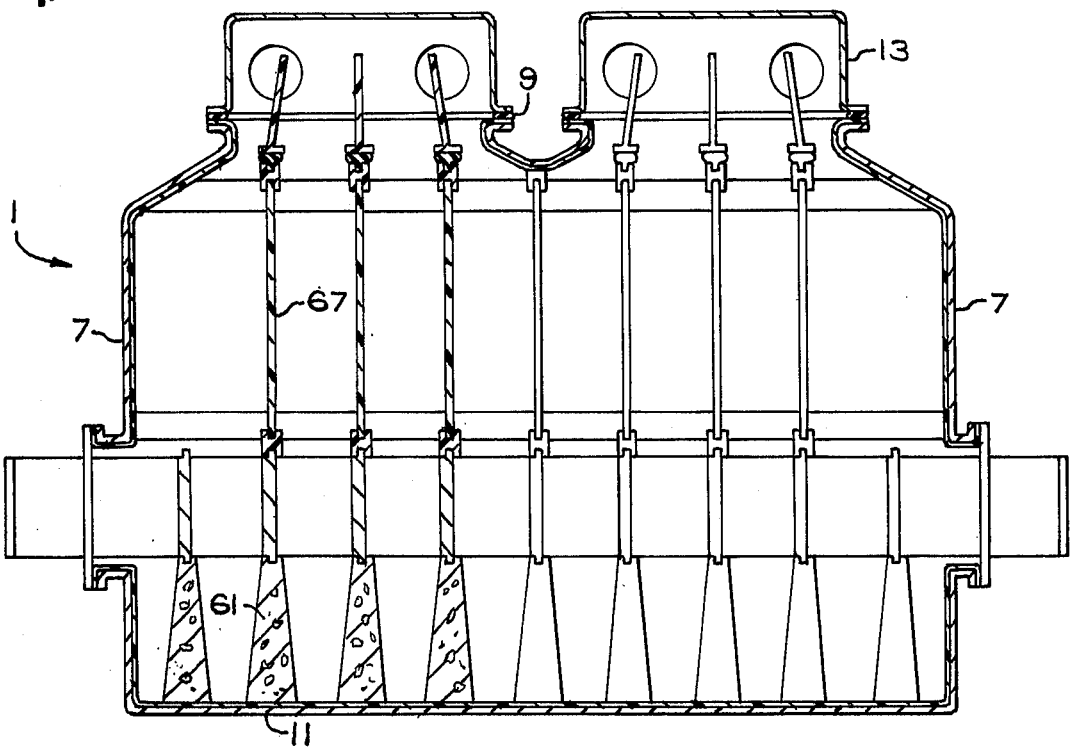
FIG. 2 is a side elevation through plane 2—2 of the bipolar electrolyzer of FIG. 1.

The bipolar electrolyzer 1 of this invention is contained in a cell body 3 having side walls 5, end walls 7, and a cell cover 9 for collecting the evolved hydrogen.

The bipolar electrolyzer of this invention, useful for the production of alkali metal chlorates, contains a plurality of individual bipolar units 41 through 47 arranged electrically and mechanically in series so that electrical current flows from an anode 71 attached to an end unit 56 of one cell 21 to a cathode 81 of that cell 21 attached to a bipolar unit 41. Electrical current then passes from the cathode 81 through the bipolar unit 41 e.g., conductor element 141 of bipolar unit 41, to an anode 71 of the next adjacent cell 22 in the electrolyzer.

In the bipolar configuration as shown in the FIGS., the anodes 71 of a bipolar unit 41 are interleaved between the cathodes 81 of the next adjacent bipolar unit 42 and the cathodes 81 of bipolar unit 42 are interleaved between the anodes 71 of the immediately preceding bipolar unit 41. The cathodes of the one cell 22 and the anodes of the next adjacent cell 23 constitute a common bipolar unit 42. The current passes from a cathode 81 of the prior cell 21 through the bipolar unit 41 e.g.; conductor element 141 of bipolar unit 41, to the anode 71 of the next adjacent cell 22 in the electrolyzer 1.

Typically, the bipolar unit 40 has a cathodic member 83 and an anodic member 73. The cathodic member 83 of the bipolar unit 40 is fabricated of an electrolyte-resistant electroconductive metal resistant to the cathodic product. Typical cathodic product resistant materials include cobalt, nickel, iron, steel, and stainless steel. Whenever ferrous metals are referred to, it will be understood to mean iron, cobalt, nickel, steel, stainless steel, and various alloys thereof. Most commonly, iron or steel will be used because of the ready availability and lower costs.

The anodic meember 73 of the bipolar unit 40 is fabricated of material that is resistant to the anodic product. For example, the anodic member may be a valve metal sheet. The valve metals are those metals which form a corrosion-resistant oxide upon exposure to either acidic media or to neutral media under anodic conditions. Such metals include titanium, zirconium, hafnium, vanadium, columbium, tantalum, and tungsten. Most commonly, when the electrolyte-resistant anodic surface is provided by a valve metal, titanium will be utilized because of its low cost and ready availability relative to the other valve metals. However, it is to be understood that other va1ve metals may be used in place thereof.

Cathode fingers 81 extend outwardly from the cathodic member 83 of the bipolar unit 40. The cathode fingers 81 are fabricated of a metal resistant to attack by the cathode products. Most typically, the cathode fingers 81 are fabricated of ferrous metals, for example, iron, alloys of iron with cobalt or nickel, and such iron alloys as steel and stainless steel. Most commonly, iron or steel is used. The cathode fingers 81 may be metal sheet or plate. Alternatively, the cathode fingers 81 may be perforate metal sheets or metal mesh. According to a still further exemplification of this invention, the cathode fingers 81 may be titanium alloys resistant to the cathode product, for example, titanium alloys with the precious metals, such as titanium alloys containing up to about 0.2 percent palladium, and titanium alloys with the rare earth metals, for example, titanium alloys containing up to about 0.02 percent of yttrium.

The cathode fingers 81 may be welded, soldered, or otherwise permanently or semi-permanently joined to the cathodic member 83 of the bipolar unit 40 as shown in the FIGS. Alternatively, the cathodes 83 may be mounted on a cathode base which is in turn bolted to the bipolar unit 40 with plated bolts. Suitable studs or conductors 141 from the cathode fingers 81 through the bipolar unit 40 to the anode fingers 71 provide electrical contact therebetween.

The anode fingers 71 are mounted on the opposite side of the bipolar unit 40, extending outwardly from the anodic member 73 of the bipolar unit 40. The metals used in fabricating the anode fingers are the valve metals, i.e., those metals which form an oxide upon exposure to acidic media or to electrolytic media under anodic conditions. As described above, the valve metals include titanium, zirconium, hafnium, vanadium, columbium, tantalum, and tungsten. Most commonly, titanium will be used for fabrication of the anodes of the electrolyzer of this invention because of the low cost and ready availability thereof.

The electroconductive surface on the anodes 71 are materials characterized by a low chlorine overvoltage and a high oxygen overvoltage. Such materials include the platinum group metals such as ruthenium, rhodium, palladium, osmium, iridium, and platinum. Suitable electroconductive surfaces are also provided by the oxides of the platinum group metals, such as ruthenium oxide, rhodium trioxide, palladium dioxide, osmium dioxide, iridium trioxide, and platinum dioxide. Particularly desirable electroconductive surfaces are those provided by solid solutions of the oxides of the platinum group metals and the oxides of the valve metals, intermetallic oxides of the platinum group metals and the valve metals, and crystalline mixtures of the platinum group metals and valve metals. For example, particularly outstanding electroconductive surfaces are provided by the combinations of ruthenium dioxide-titanium dioxide. These coatings may also further include various third oxides, for example, tin oxide, lead oxide, arsenic oxide, antimony oxide, bismuth oxide, silver oxide, gold oxide, and lead oxide.

Alternatively, the electroconductive surface on the anodes may be provided by an oxygen-containing compound of a platinum group metal and an alkaline earth metal, such as an alkaline earth ruthenate, an alkaline earth ruthenite, an alkaline earth rhodate, or an alkaline earth rhodite. Alternatively, the electroconductive surface on the anodes may be provided by oxygen-containing compounds of the platinum groups metals such as delafossites, for example, platinum cobaltate and palladium cobaltate, and by pyrochlores, such as bismuth ruthenate and bismuth rhodate. According to a still further alternative, non-previous metal-containing materials, such as lead dioxide, may be used to provide the anode surface.

The metal anodes 71 are in the form of metal fingers extending outwardly from the bipolar unit 40 toward the next adjacent bipolar unit in the electrolyzer 1. The individual anode fingers may be solid plates or they may be perforate, foraminous, mesh, or expanded mesh.

The anodes 71 may be removably mounted on the anodic member 73 of the bipolar unit 40. This may be accomplished by providing an anodic member 73 with an aperture therein suitable for carrying removable electroconductive anode support means.

According to a still further exemplification, the anodes 71 may be permanently or semi-permanently joined to the anodic member 73 of the bipolar unit 40, for example, by soldering, welding, brazing, or the like.

The anodes 71 and cathodes 81 may be interleaved between each other and may both be perpendicular to the bipolar units 40. Alternatively, they may form an angle therewith and a complementary angle with the facing bipolar unit so as to provide parallel electrodes.

Typically, in the electrolytic cell of this invention, the interelectrode gap between the anodes of one bipolar unit and the cathodes of the next adjacent bipolar unit within a single bipolar cell will be from about one-sixteenth inch to about one-fourth inch. The anodes and cathodes may further be separated from each other by ceramic or plastic rivets, for example, press-fitted into the cathode fingers, or plastic fingers mounted on electrode support structures. In this way, a compact volume is provided for actual electrolysis without direct shorting between the anodes and cathodes of an individual cell. Moreover, a large cell body may be used, thereby providing a large volume for the chlorate-forming reaction. In this way, a higher concentration of alkali metal chlorate may be formed within the electrolyte and a higher cell efficiency is obtained.

The electrolyzer contains a number of individual bipolar units, e.g., at least three or five or more, for example, as many as 50 or 100 or even 150 or more bipolar units in a single electrolyzer. The individual bipolar cells have an electrolyte volume sufficient to provide a retention time of from about 40 to about 250 milliliters per ampere and perferably from about 65 to about 200 milliliters per ampere, thereby to chemically form the alkali metal chlorate within the cell.

The individual bipolar unit 40 has an anodic member 73 fabricated of a valve metal, as described above, and having individual anodes 71 extending outwardly therefrom. The bipolar unit further has a cathodic member 83 fabricated of a ferrous metal and having cathode fingers 81 extending outwardly from the opposite side thereof. According to this invention, the anodic member 73 of the bipolar unit 40 is spaced from the cathodic member 83 of the bipolar unit 40 by an amount of at least about 1 millimeter and frequently as much as 10 millimeters or even 15 millimeters and preferably from about 3 to about 9 millimeters whereby to both allow for the collection of hydrogen therein as well as to allow for the adjustment of the relative alignment of the electrodes, for example, by compression of the gasket 91. The gasket 91 further serves to maintain the volume within the bipolar unit 40 between the anodic 73 and the cathode member 83 substantially free of electrolyte.

The bipolar unit 40 further includes a hydrogen recovery means 103. The hydrogen recovery means 103, which provides gas communication externally of the bipolar unit 40, may be fabricated of any electrolyte-resistant material.

According to this invention, means are provided for collecting the hydrogen between the anodic member 73 of the bipolar unit 40 and the cathodic member 83 of the bipolar unit 40, further means for withdrawing the hydrogen so evolved, and means for disposing of the hydrogen.

Figure 7:
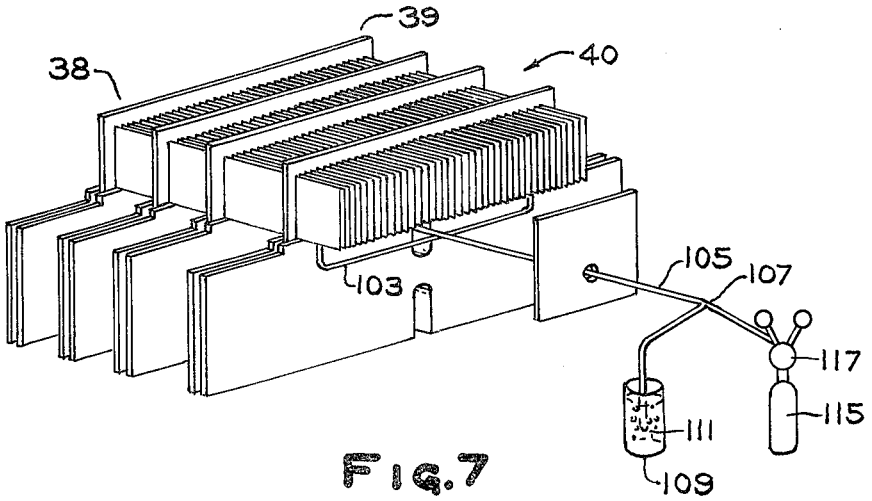
FIG. 7 is a perspective view of the bipolar units arrayed in bipolar configuration with one form of hydrogen removal means extending from the individual bipolar units.
Figure 8:
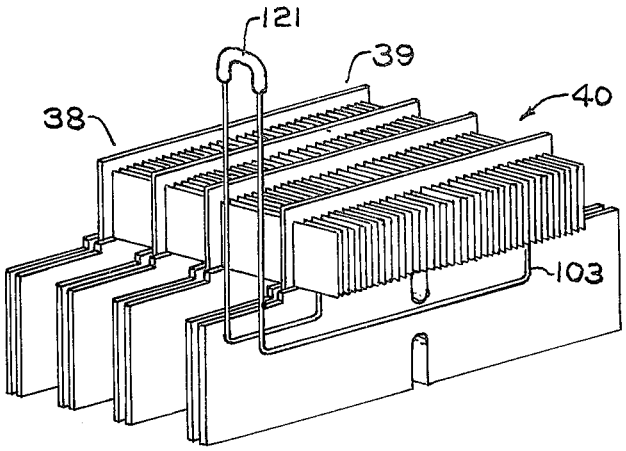
FIG. 8 is a perspective view of the individual bipolar units of the electrolyzer of this invention arrayed in bipolar configuration showing an alternative exemplification where the hydrogen removal means extends upwardly above the intended level of the electrolyte whereby to discharge the hydrogen in the gas space.
Figure 9:
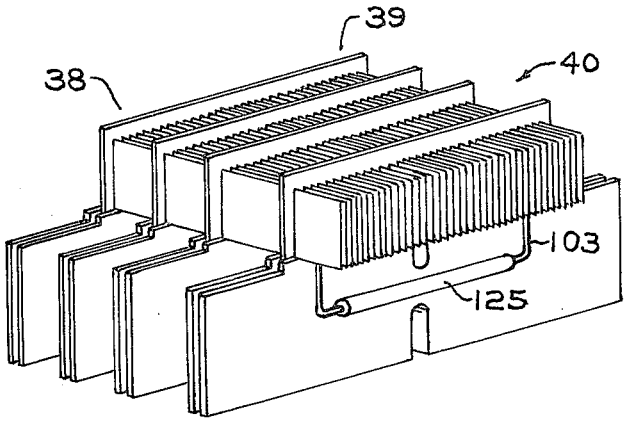
FIG. 9 is a perspective view of the bipolar units of the electrolyzer of this invention arrayed in bipolar configuration, showing the hydrogen removal means extending from the individual bipolar units to below the intended level of electrolyte in the electrolyzer.

FIG. 7 shows one exemplification of this invention where a positive pressure is maintained in the space between the anodic member 73 of the bipolar unit 40 and the cathodic member 83 of the bipolar unit 40. According to the exemplification shown in FIG. 7, hydrogen is swept out of the space between the anodic member 73 of the bipolar unit 40 and the cathodic member 83 of the bipolar unit 40 by the flow of pressurized gas.

The pressurized gas may be provided from a gas cylinder 115 through a regulator 117 or other source of pressurized gas.

Discharge of gas is through a means of maintaining a pressure within the system. Preferably, the pressure within the system is maintained above about 15 pounds per square inch in order to avoid permeation of electrolyte into the space between the anodic member 73 of the bipolar unit 40 and the cathodic member 83 of the bipolar unit 40. The pressure maintenance means may be a throttling valve or the discharge 111 of the gas below the surface of a liquid 113, for example, as a container 109 as shown in FIG. 7.

According to an alternative exemplification of this invention, the hydrogen removal means 103 includes a portion 121 located above the intended level of electrolyte in the electrolyzer. This portion 121 of the hydrogen removal means 103 is substantially permeable to the flow of hydrogen but substantially impermeable to the passage of air. In this way, the hydrogen may diffuse through the portion 121 of the hydrogen removal means 103 above the intended level of electrolyte in the electrolyzer and not collect within the bipolar unit. Typical materials useful for providing the air-impermeable, hydrogen-permeable portion 121 of the hydrogen removal means 103 include such materials are unfilled natural gum rubbers, i.e., latexes, and porous hydrophobic halogenated hydrocarbons, especially fluorocarbons.

According to a still further exemplification of this invention, the hydrogen removal means 103 extends to a portion 125 that is substantially impermeable to electrolyte, i.e., alkali metal chlorate and alkali metal chloride brine and substantially chemically resistant thereto but permeable to the flow of hydrogen. These materials include such materials as porous hydrophobic halogenated hydrocarbon polymers, especially fluoropolymers, unfilled natural gum rubbers, i.e., latexes, and silicones.

The electrolytic cell of this invention may be used for the electrolysis of alkali metal halide to yield alkali metal halates. Typically, sodium chloride may be electrolyzed to yield sodium chlorate and potassium chloride may be electrolyzed to yield potassium chlorate. Alternatively, bromides may be electrolyzed to yield bromates. According to a still further exemplification, the method of this invention may be utilized in a bipolar diaphragm cell having a diaphragm or membrane interposed between a cathode and an anode.

In the operation of this cell, a saturated brine feed, for example, from about 300 to about 325 grams per liter of sodium chloride, is fed to the electrolyzer, e.g., as make-up to a recirculating brine system. The brine feed may either be in parallel, i.e., individual brine feed to each individual electrolytic cell in a cell series, or the brine feed may be in series, i.e., to one point in the cell with the cell liquor removal at a distant point in the electrolyzer from the brine feed.

Series feed is preferred, as the feed to the first cell is low in hypochlorite ion concentration, thereby providing a high degree of chemical formation of chlorate ion at a high current efficiency.

Additionally, because of high temperatures encountered at the current densities herein contemplated, a brine feed may be used rather than a solid salt feed.

An electromotive force is imposed across the bipolar electrolyzer, thereby causing an electrical current to flow through the bipolar electrolyzer as described above. Electrolysis may then be conducted at a current density of above about 125 amperes per square foot, and preferably above about 200 amperes per square foot, and even as high as 400 or even 600 amperes per square foot or higher.

With a cell retention time of from about 40 to about 250 milliliters per ampere and preferably from about 65 to about 200 milliliters per ampere, a cell liquor is obtained having a pH of from about 5.6 to about 7.0 and preferably from about 6.5 to about 6.8. The cell liquor temperature within the cell is at least above about 50° C. and may be as high as 100° C. or even 105° C. Cell liquor temperature is generally in excess of about 80° C. and frequently as high as 95° C. or 98° C. or even 100° C.

A cell liquor is obtained containing about 650–750 grams per liter of sodium chlorate, about 60–135 and preferably about 110 to about 120 grams per liter of sodium chloride, about 1–4 grams per liter of sodium dichromate, and about 1–3 grams per liter of sodium hypochlorite.

According to the method herein contemplated, gas, e.g., hydrogen, is vented from the area between the anodic member 73 of the bipolar unit 40 and the cathodic member 83 of the bipolar unit 40, thereby avoiding the build-up of hydrogen pressure.

Although the present invention has been described with reference to specific details of particular embodiments thereof, it is not intended thereby to limit the scope of the invention except insofar as specific details are recited for the appended claims.

We claim:

1. In a method of operating a bipolar electrolyzer having an individual bipolar unit with cathodes extending outwardly from a cathodic member thereof and facing the anodes of a prior adjacent cell in the electrolyzer and anodes extending outwardly from an anodic member on the opposite side thereof and facing cathodes of a subsequent adjacent cell in the electrolyzer which method comprises passing an electrical current from the anodes of the prior cell through an electrolyte to the said cathodes, evolving hydrogen on the cathodes and the cathodic member of the bipolar unit, and passing the electrical current and atomic hydrogen through the bipolar unit to the anodes mounted on the anodic member thereof, the improvement comprising providing a space between said cathodic and anodic members in the path of said atomic hydrogen whereby the atomic hydrogen is converted to molecular hydrogen and collecting the hydrogen between the anodic and cathodic members of the bipolar unit, removing the hydrogen through a closed hydrogen removal conduit means of electrolyte impermeable, hydrogen permeable material extending from the space between the anodic and cathodic members of the bipolar unit through the electrolyte outwardly of the bipolar unit.

2. In a method operating a bipolar electrolyzer having an individual bipolar unit with cathodes extending outwardly from a cathodic member thereof and facing the anodes of an adjacent prior cell in the electrolyzer and anodes extending outwardly from an anodic member on the oppposite side thereof and facing cathodes of an adjacent subsequent cell in the electrolyzer, which method comprises passing an electrical current from the anodes of the prior cell through an electrolyte to the said cathodes, evolving hydrogen on the cathodes and the cathodic member of the bipolar unit, and passing atomic hydrogen and the electrical current through the bipolar unit to the anodes mounted on the anodic member thereof, the improvement comprising providing a space between said cathodic and anodic members in the path of said atomic hydrogen whereby the atomic hydrogen is converted to molecular hydrogen and collecting the hydrogen between the anodic and cathodic members of the bipolar unit, removing the hydrogen through a closed hydrogen removal conduit means of air impermeable, hydrogen permeable material extending from the space between the anodic and cathodic members of the bipolar unit, outwardly of the bipolar unit through and above the level of said electrolyte.

* * * * *